US008256636B2

(12) United States Patent
Huffer

(10) Patent No.: US 8,256,636 B2
(45) Date of Patent: Sep. 4, 2012

(54) TAMPER-EVIDENT PACKAGE HAVING A PEELABLE LID

(75) Inventor: Scott Huffer, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 281 days.

(21) Appl. No.: 12/712,295

(22) Filed: Feb. 25, 2010

(65) Prior Publication Data

US 2011/0204054 A1 Aug. 25, 2011

(51) Int. Cl.
*B65D 17/34* (2006.01)
*B65D 41/00* (2006.01)

(52) U.S. Cl. ..... 220/266; 220/359.1

(58) Field of Classification Search ..... 220/266, 220/265, 359.3, 359.2, 359.1, FOR. 186; 215/200, 254; *B65D 17/34, 17/28*
See application file for complete search history.

(56) References Cited

U.S. PATENT DOCUMENTS

| | | | | |
|---|---|---|---|---|
| 3,773,207 | A * | 11/1973 | Dokoupil et al. | 220/270 |
| 4,487,329 | A | 12/1984 | Winstead | |
| 4,721,210 | A * | 1/1988 | Lawrence et al. | 206/459.1 |
| 5,092,469 | A * | 3/1992 | Takata et al. | 206/245 |
| 5,178,293 | A | 1/1993 | Suzuki et al. | |
| 5,873,483 | A | 2/1999 | Görtz et al. | |
| 5,911,334 | A | 6/1999 | Helms | |
| 6,056,141 | A | 5/2000 | Navarini et al. | |
| 6,523,713 | B1 | 2/2003 | Helms | |
| 6,648,140 | B2 | 11/2003 | Petricca | |
| 6,790,508 | B2 | 9/2004 | Razeti | |
| 7,371,008 | B2 | 5/2008 | Bonenfant | |
| 2003/0183637 | A1 | 10/2003 | Zappa et al. | |
| 2004/0118852 | A1 | 6/2004 | Barmore et al. | |
| 2005/0000965 | A1 | 1/2005 | Boardman | |
| 2006/0255054 | A1 | 11/2006 | Vovan | |
| 2007/0131687 | A1 * | 6/2007 | Otto et al. | 220/212 |
| 2007/0275133 | A1 | 11/2007 | Sierra-Gomez et al. | |

FOREIGN PATENT DOCUMENTS

| | | | |
|---|---|---|---|
| FR | 1 398 922 | A | 5/1965 |
| FR | 2 682 935 | A1 | 4/1993 |
| JP | 2003 221078 | A | 8/2003 |

OTHER PUBLICATIONS

Search Report and Written Opinion for International Application No. PCT/US2011/025576 mailed Jun. 6, 2011.

* cited by examiner

*Primary Examiner* — Mickey Yu
*Assistant Examiner* — Robert J Hicks
(74) *Attorney, Agent, or Firm* — Alston & Bird LLP

(57) ABSTRACT

A tamper-evident package includes a flexible lid sealed to a flange of a container. A localized region of the flange defines a break tab that can be broken to detach a small portion, such as a corner, of the flange from the rest of the flange, in order to begin peeling back the lid to open the package. The lid is affixed to the detachable portion of the flange in a manner effectively preventing the lid from being detached from it. At least that part of the lid overlying the break tab can be sufficiently transparent that the broken or unbroken condition of the break tab can be seen through the lid from an upper side thereof. The break tab thereby serves to indicate whether the lid has been at least partially peeled back.

14 Claims, 7 Drawing Sheets

TAMPER-EVIDENT PACKAGE HAVING A PEELABLE LID

BACKGROUND OF THE INVENTION

The present disclosure relates generally to product packages, and relates more particularly to packages that include a tamper-evidence feature.

When they purchase a product from a retailer, consumers like to know that the package containing the product has not previously been opened. This is particularly true with certain types of products such as foods or other products used in or on one's body. Accordingly, it is common for product packaging to include some kind of tamper-evidence device that is supposed to indicate in a readily visible manner whether or not the package has been opened. Various types of tamper-evidence devices have been developed, such as shrink bands, pressure sensitive adhesive tabs that tear through upon opening, laser scored areas that propagate a tear in the packaging material, and devices based on delamination of inks and coextruded films.

There remains a need for a tamper-evident package having the features of the package disclosed herein.

BRIEF SUMMARY OF THE DISCLOSURE

In accordance with one aspect of the present disclosure, a tamper-evident package is described, comprising:

- a container defining a product-containing space surrounded by a side wall and having a flange projecting from an upper edge of the side wall in a direction generally away from the product-containing space, the flange having an upper surface that extends about a circumference of the side wall's upper edge;
- an area of weakness formed in the flange and extending circumferentially for a minor part of the circumference of the side wall's upper edge, the area of weakness being interrupted so as to define a break tab as an area of the flange that is initially unbroken and whose broken or unbroken condition is readily visually discernible; and
- a flexible lid sealed to the upper surface of the flange, a portion of the lid being affixed to a detachable region of the flange located outward of the break tab, such that bending and pulling on the detachable region of the flange causes the break tab to be broken and the detachable region to separate from the remainder of the flange, after which peeling of the lid can proceed;
- at least that portion of the lid overlying the break tab being sufficiently transparent that the broken or unbroken condition of the break tab can be seen through the lid from an upper side thereof.

In accordance with one embodiment, the lid comprises a multi-layer laminate comprising an upper structure joined to a lower structure, the lower structure being affixed to the flange. A lower score line is formed in the lower structure inward of the break tab, the lower score line delineating a lower opening portion that is separable from the remainder of the lower structure along the lower score line. The lower opening portion is joined to the upper structure such that lifting the upper structure during peeling of the lid causes the lower opening portion to be lifted along with the upper structure so as to create an opening in the lid for access to contents of the package. A marginal region of the upper structure extends beyond an edge of the lower opening portion and overlies an underlying surface of the lower structure, and pressure-sensitive adhesive is disposed on one of the marginal region of the upper structure and the underlying surface of the lower structure for re-adhering the marginal region to the underlying surface so as to close the opening in the lid after a first or subsequent opening of the package.

The lower structure preferably is cut along a line proximate the break tab to allow an adjacent portion of the lower structure to remain attached to the detachable region of the flange after breaking of the break tab and during peeling of the lid.

In one embodiment, the lower opening portion of the lower structure is joined to the upper portion by a laminating adhesive providing a bond strength greater than that provided by the pressure-sensitive adhesive. The laminating adhesive can be a permanent laminating adhesive.

In accordance with one embodiment, the flange defines a pair of adjacent but spaced-apart holes extending through a thickness of the flange such that the break tab is formed by material of the flange located between the holes. The area of weakness in the flange can include score lines that extend from each hole to an outer edge of the flange proximate each hole.

The detachable region of the flange can be a corner of the flange defined by two outer edges that intersect to form the corner, the score lines extending across the corner between the two outer edges.

In another embodiment, the lid does not include a transparent region overlying the break tab. The broken or unbroken condition of the break tab is evident through a visual inspection of the corner region of the package (since breakage of the break tab generally results in distortion of the corner region) and/or by feeling the corner region to determine whether it is still firmly attached to the rest of the flange.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
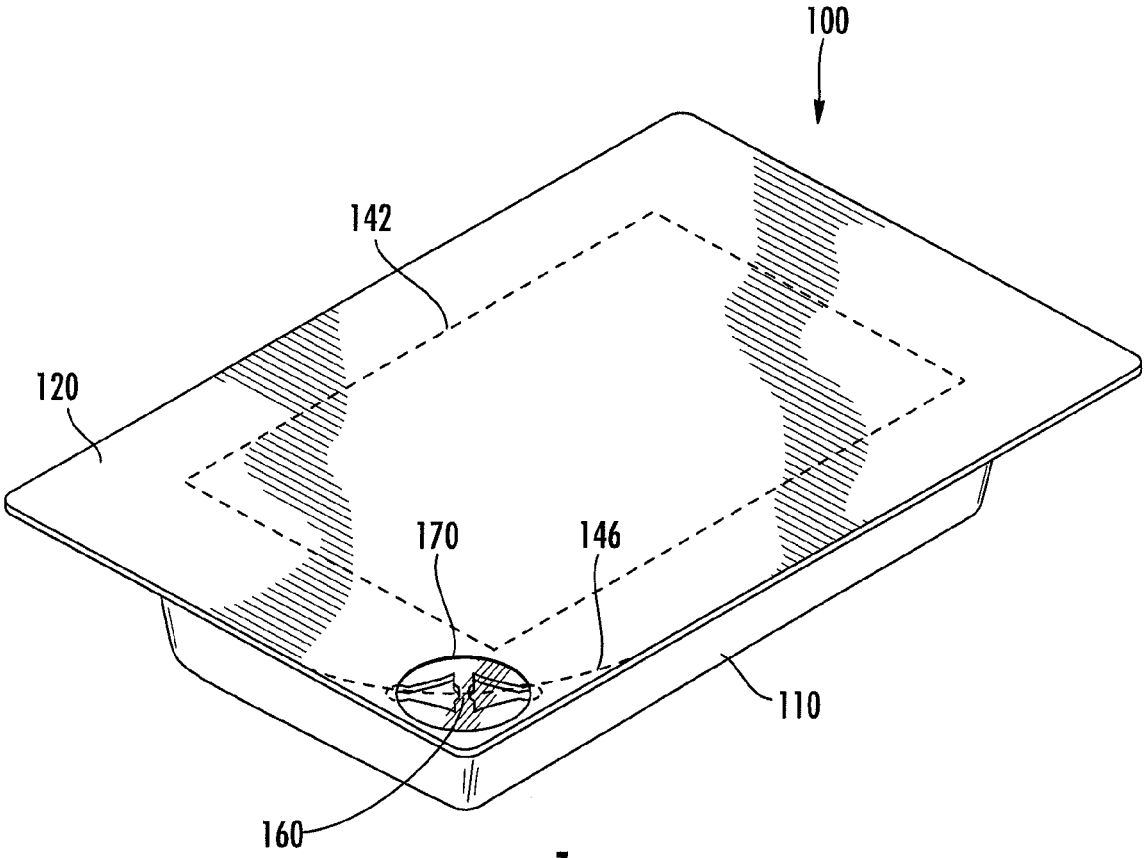
FIG. 1 is a perspective view of a package having a tamper-evident feature, in accordance with one embodiment of the invention.
Figure 2:
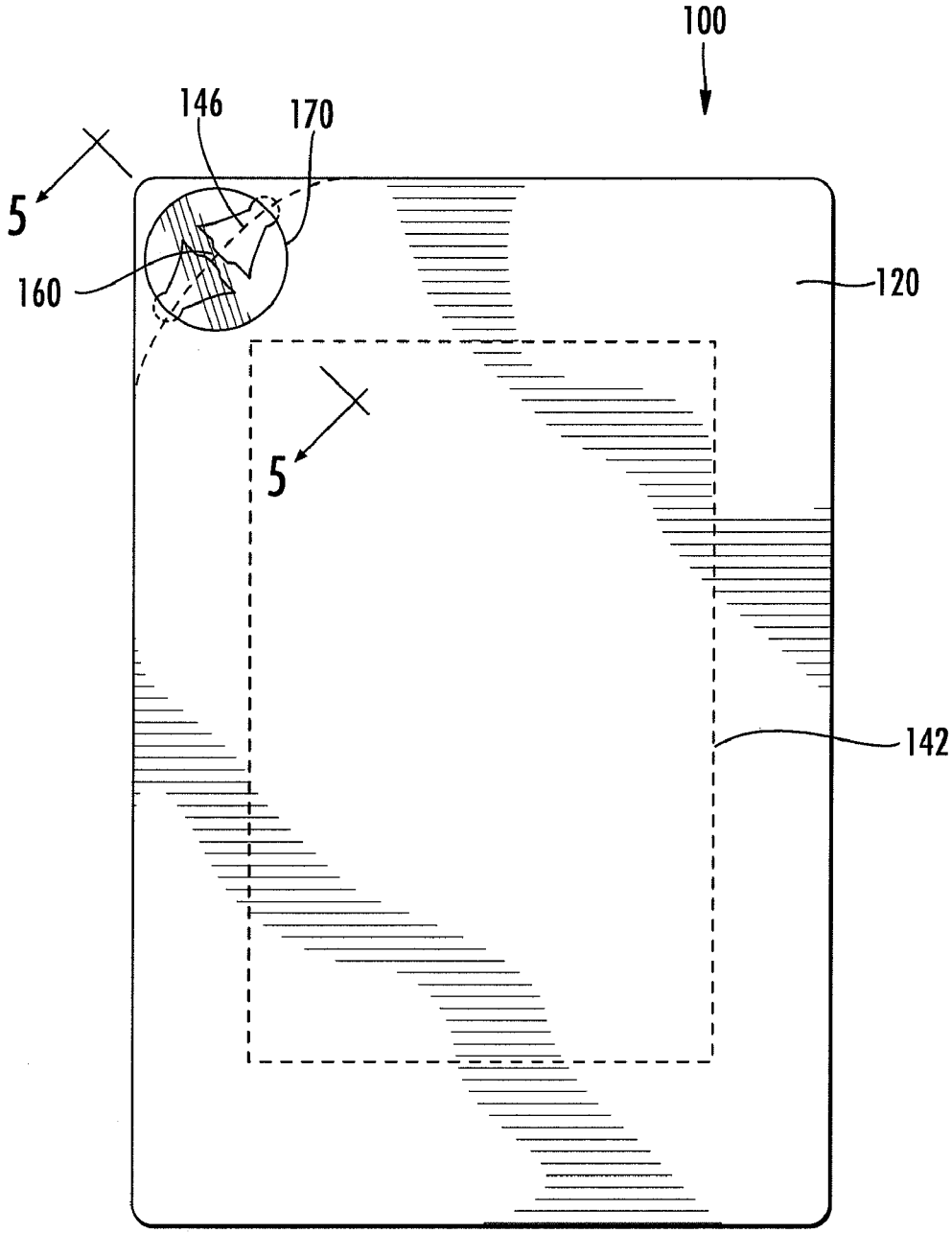
FIG. 2 is a top view of the package of FIG. 1.
Figure 3:
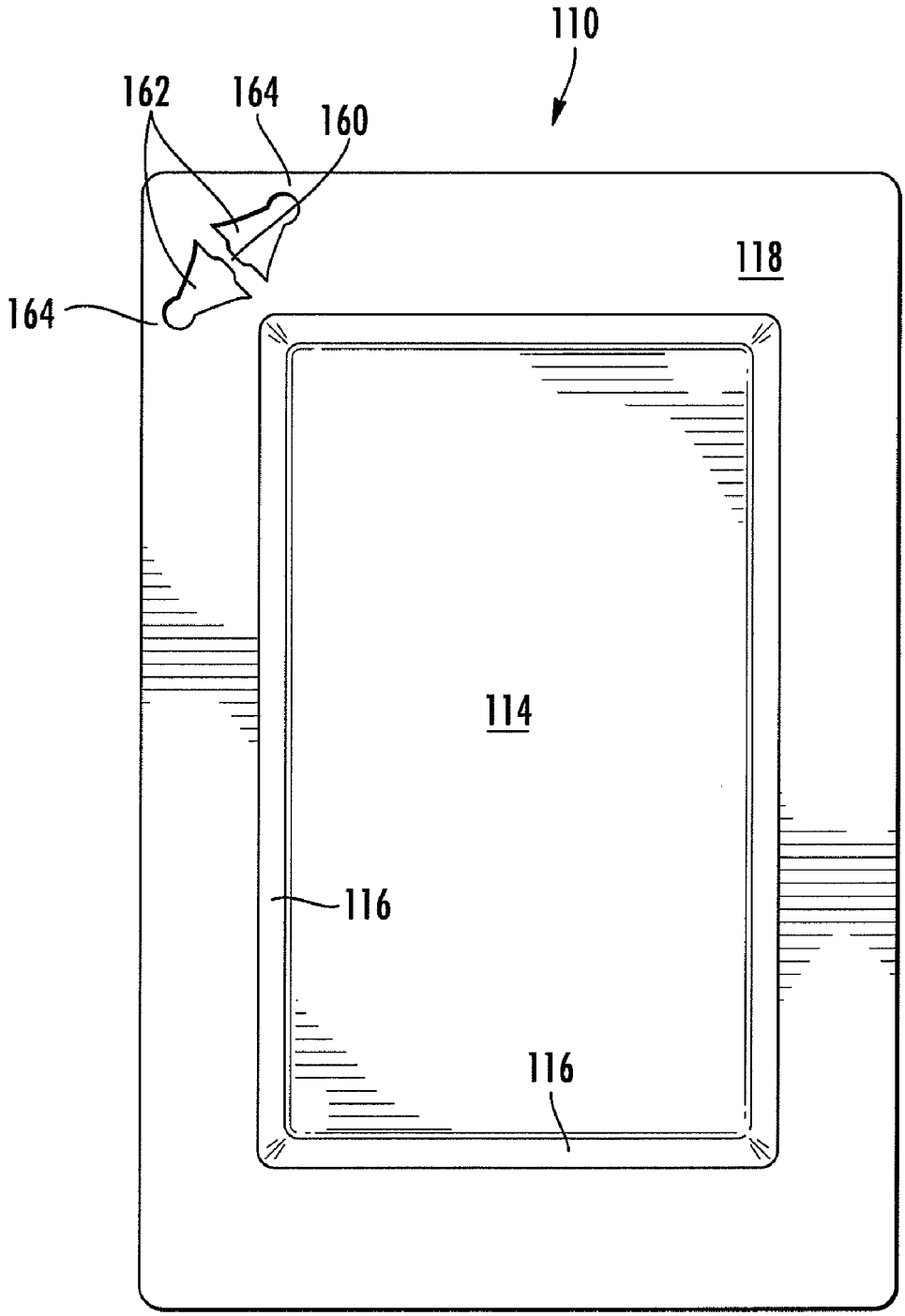
FIG. 3 is a top view of the tray portion of the package in FIG. 1.
Figure 4:
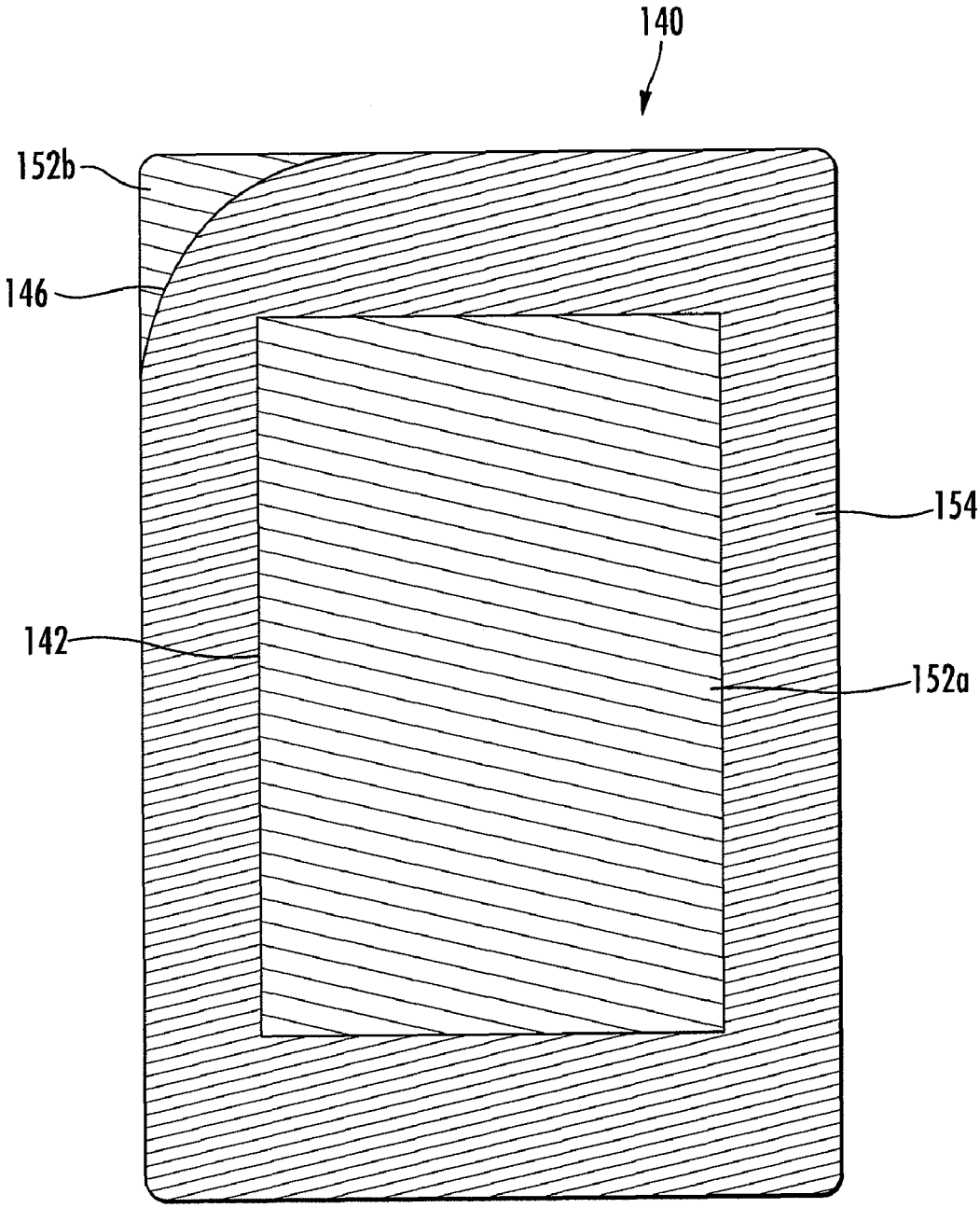
FIG. 4 is a plan view of one layer of the multilayer membrane lid after the adhesives have been applied.

A package 100 in accordance with one embodiment of the present invention is depicted in FIGS. 1, 2, 5, 6, and 7, and components of the package are shown in FIGS. 3 and 4. The major components of the package include a container 110 and a flexible membrane lid 120 that is sealed to the container and has a built-in opening and reclose feature allowing the lid to be peeled back to create an opening for access to the container contents, and then replaced in its original position to reclose the package. The package also includes a tamper-evident feature that indicates in a readily visible manner whether or not the package has been opened or tampered with in an attempt to open it.

Figure 5:
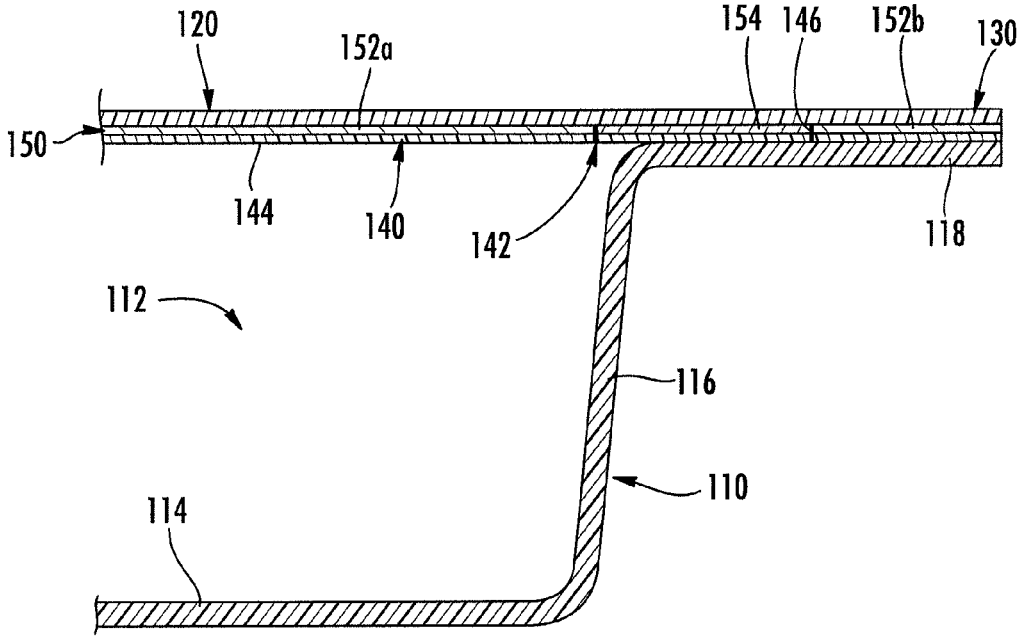
FIG. 5 is a cross-sectional view through the package along line 5-5 in FIG. 1, showing the package in a closed condition before it has been opened for the first time.

With primary reference to FIGS. 3 and 5, the container 110 has a receptacle portion 112 formed by a bottom wall 114 and a side wall (or plurality of adjoined side walls) 116 that extends upwardly from an outer edge of the bottom wall and encircles or encompasses a product-containing space of the receptacle portion. The container can have any plan shape, including rectangular as shown in FIG. 3, but also including any other desired shape (square, triangular, round, oval, elliptical, etc.). The illustrated container 110 can be described as a tray (i.e., relatively shallow in depth in comparison with the length and width dimensions), but the invention is not limited to tray-type containers, being applicable also to other configurations of containers such as containers that are comparatively deep. The container can be formed of any of various materials, and by any of various manufacturing methods. In any case, the container includes a flange 118 that is adjoined to an upper edge of the side wall 116 and extends outwardly therefrom (relative to the product-containing space), defining an upper surface that is generally planar and that encircles the upper end of the receptacle portion. The membrane lid 120 is sealed to this upper surface of the flange 118 to enclose the contents in the package.

With reference to FIGS. 4 and 5, the membrane lid 120 is a multilayer laminate 150 comprising an upper structure 130 adhesively laminated to a lower structure 140. In FIG. 5 the upper structure 130 is depicted as a single layer of material, but the invention is not so limited, and the upper structure could instead consist of two or more layers of material joined together, as long as such layers remain together and form an essentially unitary upper structure. Likewise, the lower structure 140 is depicted as a single layer of material, but it could instead consist of two or more layers of material joined together to form an essentially unitary lower structure. The upper structure 130 is joined to the lower structure 140 by adhesives. Specifically, the adhesives include regions 152*a* and 152*b* of "permanent" laminating adhesive and at least one region 154 of "peelable" pressure-sensitive adhesive (PSA). By "permanent" and "peelable" is meant that the peel force required to peel apart the upper and lower structures in the regions of the permanent adhesive is substantially higher than that required to peel them apart in the region of the peelable PSA. Preferably, the bond strength provided by the permanent adhesive is high enough to make it essentially impossible to peel one structure from the other structure and leave the structures intact and in good condition. In contrast, the bond strength provided by the peelable PSA is low enough to allow the structures to be peeled apart intact and in good condition; additionally, the PSA is tacky and allows the structures to be reattached to each other after they have been peeled apart. This is further described below.

The pressure-sensitive adhesive can comprise various compositions. Pressure-sensitive adhesives form viscoelastic bonds that are aggressively and permanently tacky, adhere without the need of more than a finger or hand pressure, and require no activation by water, solvent or heat. Pressure-sensitive adhesives are often based on non-crosslinked rubber adhesives in a latex emulsion or solvent-borne form, or can comprise acrylic and methacrylate adhesives, styrene copolymers (SIS/SBS), and silicones. Acrylic adhesives are known for excellent environmental resistance and fast-setting time when compared with other resin systems. Acrylic pressure-sensitive adhesives often use an acrylate system. Natural rubber, synthetic rubber or elastomer sealants and adhesives can be based on a variety of systems such as silicone, polyurethane, chloroprene, butyl, polybutadiene, isoprene, or neoprene. When the package of the invention is to be used for food packaging, the pressure-sensitive adhesive generally must be a food-grade composition. Various pressure-sensitive adhesives are approved by the U.S. Food and Drug Administration for use in direct food contact, as regulated by 21 CFR Part 175.300. Additives (e.g., particulates or the like) can be added to the pressure-sensitive adhesive to reduce the tenacity of the bond, if necessary. It is preferred that the pressure-sensitive adhesive be applied to the upper structure 130 and remain on the upper structure when it is peeled from the lower structure; alternatively, however, the PSA could be applied to the lower structure.

The permanent adhesive can comprise any of various compositions. Suitable examples include two-component polyurethane adhesive systems, but the invention is not limited to any particular permanent adhesive.

Each of the upper and lower structures 130, 140 can be made from layers of any of various materials. The lower structure of the laminate advantageously includes a sealant layer forming the lowermost surface of the laminate. The sealant layer can comprise a heat seal material such as polyethylene, polypropylene, ionomer resin such as SURLYN®, or the like, or a cold seal material. The heat seal or cold seal layer can comprise either a film or a coating. The lower structure advantageously also includes a barrier layer providing a barrier against the passage of moisture and/or oxygen. In some applications such as the packaging of moisture-sensitive products (e.g., cookies or similar products that tend to be degraded when exposed to the environment), it is important to provide a moisture barrier. The barrier layer can comprise any of various polymer-based barrier materials including barrier polymer films such as ethylene vinyl alcohol copolymer (EVOH), polyamide, and the like; metallized polyolefin films such as polyethylene, polypropylene, oriented polypropylene, and the like; $AlO_x$-coated polymer films; $SiO_x$-coated polymer films; metal foil such as aluminum foil; and others. Although the term "barrier layer" is used in connection with metallized films to refer to the entire metallized film, it will be recognized that it is the layer of metal that provides the barrier function. Likewise, it is the $AlO_x$ or $SiO_x$ coating that provides the barrier function in the ceramic-coated films, but the entire film nevertheless is referred to herein as a "barrier layer".

The upper structure advantageously includes a layer of polyester such as polyethylene terephthalate, which has a desirable crisp feel and is readily printed. The polyester layer can be printed with inks to provide graphics and indicia. In preferred embodiments, the polyester layer is transparent and can be reverse-printed on the surface that faces the lower structure.

As noted, the lid 120 includes a built-in opening and reclose feature, which is now described with reference to FIGS. 1, 2, 4, 5, and 6. The built-in opening and reclose feature is also substantially as described in co-pending, commonly assigned U.S. patent application Ser. No. 11/098,872 filed on Apr. 5, 2005, the entire disclosure of which is hereby incorporated herein by reference. In particular, the opening and reclose feature is comprised of the above-described regions of permanent and pressure-sensitive adhesives working in conjunction with a score line 142 formed in the lower structure 140 of the lid 120. The score line 142 is spaced inwardly of the outer periphery of the lid 120, and preferably (but not essentially) is proximate the inner edge of the flange 118 on the container. The score line 142 forms either a closed loop (such as the rectangular loop shown in the drawings) or a generally U-shaped configuration so as to form a plug or flap 144 (also referred to herein as a "lower opening portion") consisting of the portion of the lower structure 140 bounded by the score line 142. The flap 144 is attached to the upper structure 130 by the permanent adhesive, which is applied to one of the upper and lower structures by any suitable pattern applicator so that the permanent adhesive region 152*a* (FIG. 4) covers only the portion of the structure that will be bounded by the score line 142. In FIG. 4, the lower structure 140 is shown in isolation, including the score line 142 and the adhesive regions 152*a*, 152*b*, and 154, but this is done only for clarity of illustration and to facilitate explanation, not to suggest that the adhesives are necessarily applied to the lower structure prior to its lamination to the upper structure. In fact, in preferred embodiments the adhesives are applied to the upper structure 130, then the two structures are laminated to each other, and then the score line 142 is formed through the lower structure 140 but not through the upper structure.

In the region 154 of the structures lying outward of the score line 142 (and outward of the permanent adhesive region 152*a*), the pressure-sensitive adhesive is applied to one of the structures by any suitable pattern applicator. However, in a small region 152*b* of the structures that corresponds to one corner of the lid, permanent adhesive is applied by the permanent adhesive applicator, for reasons that will become apparent below. After application of the adhesives, as noted, the upper and lower structures are laminated together. The laminate is then processed by any suitable scoring device (e.g., a die cutter or a laser) to form the score line 142 through the thickness of the lower structure 140. Additionally, the scoring device forms a line of weakening or score line 146 in the lower structure along a line that separates the pressure-sensitive adhesive region 154 from the permanent adhesive region 152*b* at the corner. The lid 120 is die cut from the resulting laminate by cutting fully through the thickness of the laminate along a closed loop (corresponding to the desired size and shape of the lid) that bounds the outer edges of the pressure-sensitive adhesive region 154 and the corner permanent adhesive region 152*b*. The lid is then ready to be sealed to the flange 118 of the container 110.

As noted, the lower surface of the lower structure 140 advantageously is formed by a heat seal material. Correspondingly, the upper surface of the container flange 118 comprises a heat seal material (either by virtue of the flange being coated with a heat seal material, or the flange material itself being a heat seal material). After the products are inserted into the container, the lid 120 is heat sealed to the flange 118. The heat seal between the lid and the flange is so strong that it is essentially impossible to peel the lid from the flange while leaving the lid intact and in good condition. Accordingly, tampering by peeling the lid from the flange is effectively impossible.

Figure 6:
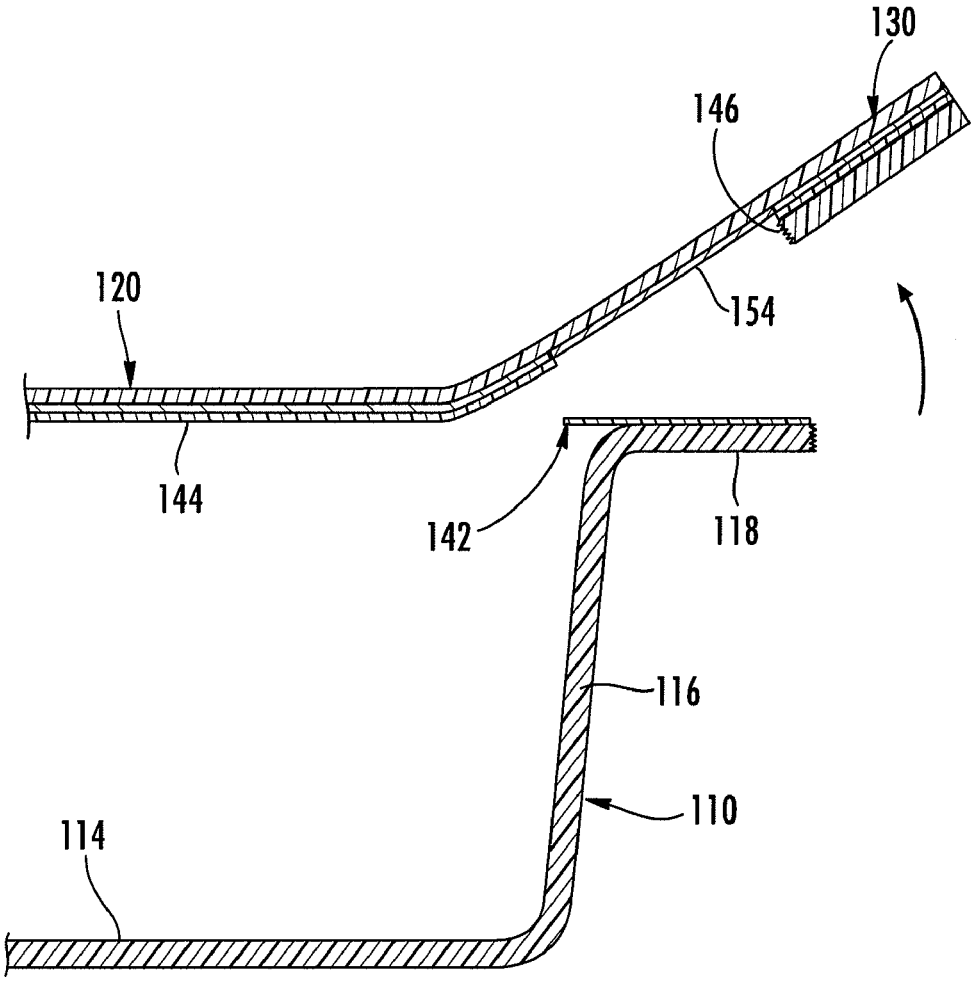
FIG. 6 is a view similar to FIG. 5, showing the package in the process of being opened.

The package 100 is opened by peeling the upper structure 130 from the lower structure 140 of the lid. This is possible because of the presence of the pressure-sensitive adhesive in the outer region 154 of the lid, except for the small permanent adhesive region 152*b* at one corner. When the upper structure is peeled from the lower structure, and the peeling reaches the score line 142, the flap 144 of the lower structure remains attached to the upper structure because of the presence of the permanent adhesive in the region 152*a*. Accordingly, the flap 144 separates from the remainder of the lower structure along the score line 142, thereby creating an opening through the lid for access to the container contents, as illustrated in FIG. 6.

The tamper-evident feature of the package 100 is now described with primary reference to FIGS. 2, 3, 5, 6, and 7. The feature takes advantage of the fact that the lid as a whole cannot be peeled from the flange of the container, and the fact that it is essentially not possible to begin peeling the upper structure 130 from the lower structure 140 of the lid at any location other than the corner of the lid having the permanent adhesive region 152*b* and the score line 146. In the corresponding corner region of the container flange 118, as best seen in FIG. 3, the flange is die cut or otherwise operated upon so as to form an area of weakness in the flange that extends circumferentially for a minor part of the circumference of the flange, the area of weakness being interrupted so as to define a break tab 160 as an area of the flange that is initially unbroken and whose broken or unbroken condition is readily visually discernible. In the illustrated embodiment, the break tab 160 is formed by creating two adjacent holes 162 entirely through the thickness of the flange, the holes being spaced apart such that the flange material between the holes forms the break tab. As shown, the edges of the holes bounding the break tab can be shaped such that the break tab has one narrow region at which breakage of the break tab can preferentially occur. The holes 162 can be shaped and positioned such that there are also regions 164 of the flange between the holes and the outer edges of the flange that must be broken in order to separate the corner portion of the flange from the remainder of the flange in order to open the package. These regions 164 can be scored, if desired, to facilitate separation of the corner portion. Alternatively, the holes 162 can extend all the way to the edges of the flange so there are no additional regions of the flange except the break tab 160 that must be broken.

Figure 7:
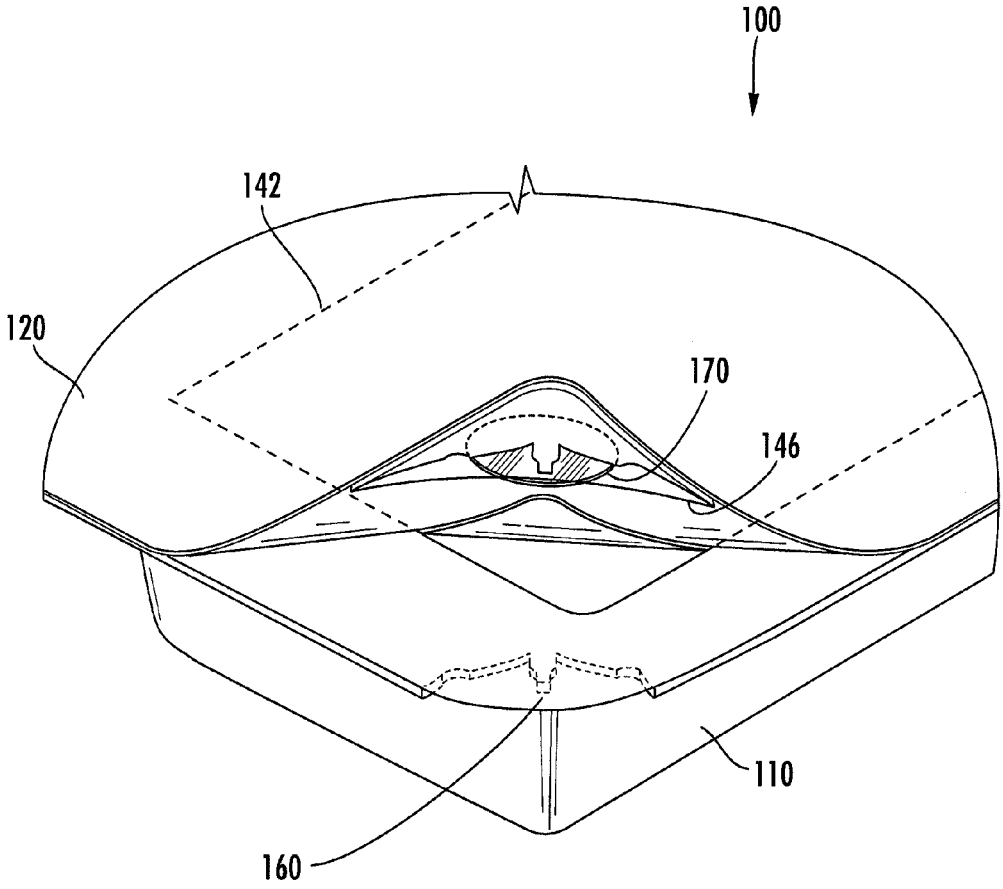
FIG. 7 is a perspective view of the package of FIG. 1 in the process of being opened.

When the lid 120 is sealed to the flange 118, the corner portion of the lid having the permanent adhesive region 152*b* is sealed to the corner portion of the flange 118 lying directly outward of the break tab 160. Accordingly, to open the package, the user grasps the corner portion of the flange and the corner portion of the lid affixed thereto, and (possibly after folding the corner portion up or down about a hinge line extending across the corner through the break tab 160 in order to weaken the break tab) pulls generally upwardly and inwardly on the corner portion to cause the break tab 160 to break. In this process, the lower structure 140 of the lid will also separate along the score line 146 so that the portion of the lower structure 140 inward of the score line 146 can remain affixed to the portion of the flange 118 inward of the break tab 160. Thus, as shown in FIGS. 6 and 7, the user is left holding the outer corner portion of the flange 118 and the corner portion of the lid outward of the score line 146, and the user continues to peel the lid back until the peeling reaches the score line 142 in the lower structure. The lower structure separates along the score line 146 such that the upper structure 130 begins to peel from the lower structure 140, thereby exposing the pressure-sensitive adhesive region 154 (which, in the illustrated embodiment preferably remains on the upper structure 130, but alternatively could remain on the lower structure). As the user then continues to peel the lid back, the lower structure separates along the score line 142, and the flap 144 of the lower structure is lifted along with the upper structure so that an opening is created through the lower structure to access the container contents.

The marginal region of the upper structure 130 that extends beyond the edge of the lower opening portion or flap 144 overlies an underlying surface of the lower structure 140. The pressure-sensitive adhesive is disposed on either this marginal region of the upper structure (as illustrated in FIG. 6) or on the underlying surface of the lower structure. This allows the lid to be re-adhered to the underlying surface so as to close the opening in the lid to keep the remaining contents in the package fresh.

The tamper-evident feature in one embodiment also entails ready visibility of the broken or unbroken condition of the break tab 160. Toward this end, the lid can include a transparent region or "window" 170 that overlies the break tab 160 such that the break tab can be seen through the lid from an upper side thereof. Thus, for example, the upper and lower structures of the lid, and the adhesives that join them together, can be substantially transparent prior to any printing of graphics or indicia on the lid. Typically, the upper structure 130 can be reverse-printed (i.e., printed on the side facing the lower structure 140) prior to lamination of the structures. The printing pattern can include an unprinted region overlying the break tab so as to form the transparent window.

Many modifications and other embodiments of the inventions set forth herein will come to mind to one skilled in the art to which these inventions pertain having the benefit of the teachings presented in the foregoing descriptions and the associated drawings. For example, while the illustrated embodiment has a transparent window 170 in the lid overlying the break tab, alternatively the lid does not have to include a transparent region. The broken or unbroken condition of the break tab in this case can be ascertained through a visual inspection of the corner region of the package (since breakage of the break tab generally results in distortion of the corner region) and/or by feeling the corner region to determine whether it is still firmly attached to the rest of the flange. Furthermore, while the package as shown and described herein has a generally rectangular plan shape, the package alternatively can be any other desired shape. Various other alterations and modifications of the concepts disclosed herein can also be adopted, as would be apparent to persons of ordinary skill in the art. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A tamper-evident package comprising:

a container defining a product-containing space surrounded by a side wall and having a flange projecting from an upper edge of the side wall in a direction generally away from the product-containing space, the flange having an upper surface that extends about a circumference of the side wall's upper edge;

an area of weakness formed in the flange and extending circumferentially for a minor part of the circumference of the side wall's upper edge, the area of weakness being adjacent to a break tab defined as an area of the flange that is initially unbroken and whose broken or unbroken condition is readily visually discernible; and a flexible lid sealed to the upper surface of the flange, a portion of the lid being affixed to a detachable region of the flange located outward of the break tab, such that bending and pulling on the detachable region of the flange causes the break tab to be broken and the detachable region to separate from the remainder of the flange, after which peeling of the lid can proceed;

at least that portion of the lid overlying the break tab being sufficiently transparent that the broken or unbroken condition of the break tab can be seen through the lid from an upper side thereof.

2. The tamper-evident package of claim 1, wherein the lid comprises a multi-layer laminate comprising an upper structure joined to a lower structure, the lower structure being affixed to the flange, a lower score line being formed in the lower structure inward of the break tab, the lower score line delineating a lower opening portion that is separable from the remainder of the lower structure along the lower score line, the lower opening portion being joined to the upper structure such that lifting the upper structure during peeling of the lid causes the lower opening portion to be lifted along with the upper structure so as to create an opening in the lid for access to contents of the package; and wherein the lower structure is cut or weakened along a line proximate the break tab to allow an adjacent portion of the lower structure to remain attached to the detachable region of the flange after breaking of the break tab.

3. The tamper-evident package of claim 2, wherein a marginal region of the upper structure extends beyond an edge of the lower opening portion and overlies an underlying surface of the lower structure, and pressure-sensitive adhesive is disposed on one of the marginal region of the upper structure and the underlying surface of the lower structure for re-adhering the marginal region to the underlying surface so as to close said opening in the lid.

4. The tamper-evident package of claim 3, wherein the lower opening portion of the lower structure is joined to the upper portion by a laminating adhesive providing a bond strength greater than that provided by the pressure-sensitive adhesive.

5. The tamper-evident package of claim 2, wherein the flange defines a pair of adjacent but spaced-apart holes extending through a thickness of the flange such that the break tab is formed by material of the flange located between the holes.

6. The tamper-evident package of claim 5, wherein each of the holes extends to proximate an outer edge of the flange.

7. The tamper-evident package of claim 6, wherein the detachable region of the flange is a corner of the flange defined by two outer edges that intersect to form the corner, the area of weakness extending across the corner between the two outer edges.

8. The tamper-evident package of claim 2, wherein the lower score line of the lid has a generally U-shaped or quadrilateral configuration such that the lower opening portion forms a flap that is lifted with the upper structure when the lid is peeled back.

9. The tamper-evident package of claim 2, wherein the lower structure includes a layer of heat-sealable material forming a bottom surface of the lid.

10. The tamper-evident package of claim 2, wherein the upper structure comprises a layer of polyethylene terephthalate, and the lower structure comprises a layer of oriented polypropylene.

11. A tamper-evident package comprising:

a container defining a product-containing space surrounded by a side wall and having a flange projecting from an upper edge of the side wall in a direction generally away from the product-containing space, the flange having an upper surface that extends about a circumference of the side wall's upper edge;

an area of weakness formed in the flange and extending circumferentially for a minor part of the circumference of the side wall's upper edge, the area of weakness being adjacent to a break tab defined as an area of the flange that is initially unbroken and whose broken or unbroken condition is readily visually discernible; and a flexible lid sealed to the upper surface of the flange, a portion of the lid being affixed to a detachable region of the flange located outward of the break tab, such that bending and pulling on the detachable region of the flange causes the break tab to be broken and the detachable region to separate from the remainder of the flange, after which peeling of the lid can proceed, wherein the lid comprises a multi-layer laminate comprising an upper structure joined to a lower structure, the lower structure being affixed to the flange, a lower score line being formed in the lower structure inward of the break tab, the lower score line delineating a lower opening portion that is separable from the remainder of the lower structure along the lower score line, the lower opening portion being joined to the upper structure such that lifting the upper structure during peeling of the lid causes the lower opening portion to be lifted along with the upper structure so as to create an opening in the lid for access to contents of the package;

wherein the lower structure is cut along a line proximate the break tab to allow an adjacent portion of the lower structure to remain attached to the detachable region of the flange after breaking of the break tab.

12. The tamper-evident package of claim 11, wherein a marginal region of the upper structure extends beyond an edge of the lower opening portion and overlies an underlying surface of the lower structure, and pressure-sensitive adhesive is disposed on one of the marginal region of the upper structure and the underlying surface of the lower structure for re-adhering the marginal region to the underlying surface so as to close said opening in the lid.

13. The tamper-evident package of claim 12, wherein the lower opening portion of the lower structure is joined to the upper structure by a laminating adhesive providing a bond strength greater than that provided by the pressure-sensitive adhesive.

14. The tamper-evident package of claim 11, wherein the flange defines a pair of adjacent but spaced-apart holes extending through a thickness of the flange such that the break tab is formed by material of the flange located between the holes.

* * * * *